US006149155A

United States Patent [19]

Hoyt et al.

[11] Patent Number: 6,149,155

[45] **Date of Patent: *Nov. 21, 2000**

[54] PLAYING CARDS

[76] Inventors: David Lawrence Hoyt, 10 E. Elm St., Suite 308, Chicago, Ill. 60611; Stephen Martin Flaherty, 3723 W. 114th Pl., Chicago, Ill. 60604

[ * ] Notice: This patent issued on a continued prosecution application filed under 37 CFR 1.53(d), and is subject to the twenty year patent term provisions of 35 U.S.C. 154(a)(2).

[21] Appl. No.: 09/034,980

[22] Filed: Mar. 5, 1998

[51] Int. Cl.[7] ..... A63F 1/00

[52] U.S. Cl. ..... 273/292; 273/293; 273/304; D21/376; D21/378; D21/379

[58] Field of Search ..... 273/293, 292, 273/304; D21/376, 378, 379, 383, 384

[56] References Cited

U.S. PATENT DOCUMENTS

| | | | |
|---|---|---|---|
| D. 169,847 | 6/1953 | Inman . | |
| D. 212,239 | 9/1968 | Schick . | |
| D. 222,490 | 10/1971 | Alaska | D21/1 |
| 599,767 | 3/1898 | Clarke . | |
| 1,549,095 | 8/1925 | Levine . | |
| 4,050,698 | 9/1977 | Brown | 273/304 |
| 4,461,483 | 7/1984 | Kopp . | |
| 4,666,163 | 5/1987 | Hirschfeld | 273/293 |
| 5,141,235 | 8/1992 | Hernandez | 273/308 |
| 5,324,040 | 6/1994 | Panda | 273/272 |
| 5,697,616 | 12/1997 | Wilyard | 273/303 |

*Primary Examiner*—Benjamin H. Layno
*Attorney, Agent, or Firm*—Baniak Nicholas Pine & Gannon

[57] ABSTRACT

A deck of game playing cards is disclosed containing approximately 104 playing cards, each card having a back side which is similar to each of the other playing cards such that the cards cannot be distinguished by observing the back side, and a front side containing an indication of location, quantity and suit, such that when a first playing card is placed adjacent to a second playing card, the combination results in a playing card similar to a standard playing card, but approximately twice the size of the standard playing card.

21 Claims, 3 Drawing Sheets

PLAYING CARDS

TECHNICAL FIELD

The present invention relates to a novel deck of playing cards, and more specifically, the present invention relates to a novel deck of playing cards made up of at least 104 cards, divided into four different suit types, containing 26 cards in each suit numbered either 2 through 10, or containing the letters A, K, Q, or J. In order to account for the 26 different cards, there are two of each numbered and lettered cards, one is labeled the top card portion and the other is labeled the bottom card portion. The top and bottom card portions are configured such that, when the corresponding top and bottom cards are placed adjacent to each other with the top card above or on top of the bottom card, a single card is created similar to those found in a standard deck of cards, however the newly created card is approximately twice the size of the standard card.

BACKGROUND OF THE INVENTION

Playing cards have been in existence for many years. Although there are many types of playing cards that are played in many different types of games, the most common type of playing cards consists of 52 cards, divided out into four different suits (namely Spades, Hearts, Diamonds and Clubs) which is printed or indicated on one side or the face of each card. In the standard deck, each of the four suits consists of 13 cards, numbered either two through ten, or lettered A (Ace), K (King), Q (Queen), or J (Jack), which is also printed or indicated on each card. Thus each card will contain on its face a suit indication along with a number or letter indication. The King, Queen, and Jack usually also include some sort of design on the face of the card, and may be referred to as picture cards.

In some cases, the 52 card standard playing deck also contains a number of extra cards, sometimes referred to as jokers, that may have some use or meaning depending on the particular game being played with the deck.

Many different games can be played using a standard 52 card deck. The game being played with the standard deck of cards may include other items, such as game boards, chips, etc., or the game being played may only need the playing card deck itself. In most of the games played using a standard deck of cards, a value is assigned to each card. The value may differ for different games. Usually, the card value begins with the number two card as the lowest value and increases as the numbers increase through ten, followed in order of increasing value with the Jack, Queen, King and Ace. In some games the Ace may have a lower value than the two, and in games where a particular card is determined to be wild, or have any value, that card may have the greatest value of all. For example, in card games where deuces, or twos, are wild, the player holding a playing card containing a two can use that two as any other card, such that a nine and a two would be the equivalent of two nines.

Further, the four different suits indicated on the cards may have a particular value depending on the game. Under game rules where one suit, i.e. Spades, has more value than another suit, i.e. Hearts, the seven of Spades may have more value than the seven of Hearts.

It is easy to visualize that using the different card quantity and suit values, many different games can be played. In certain games, it is the combination of cards that one player obtains that determines whether or not that player has defeated the other player or players. Usually, the more difficult the combination is to obtain, the more value the combination has, and the player who obtains the more difficult combination (also taking into account the value of the cards) wins the game. For instance in the game of Poker, each player may ultimately receive five cards. The player who obtains three cards having similar numbers on their face, i.e. the four of Hearts, four of Diamonds and four of Clubs, will defeat the player having only two cards with the same numerical value, i.e. the King of Spades and the King of Hearts. However, the player with five cards that all contain Clubs, commonly known as a flush, will defeat the player with the same three of a kind described above.

It is easy to see that many different games can be played using the increasing value of the cards and the different combination of those cards. However, there are a limited number of combinations that can be created with an ordinary deck of playing cards.

SUMMARY OF THE INVENTION

The present invention greatly increases the number of combinations that can be created without increasing the number of suits in a deck nor the different values of each card, which, over the years, have become well known by card players. The present invention doubles the size of the standard deck of playing cards from 52 to 104 cards (not including jokers). The deck still contains only four suits (usually Spades, Hearts, Diamonds and Clubs), and still contains cards with either a numerical value of two through ten, or a letter value of A (ace), K (King), Q (Queen) or J (Jack). However, each card is divided into two separate cards, containing different location indicators such as bottom and top, or left and right. For example, the present invention has two three of Diamonds, the top three of Diamonds and the bottom three of Diamonds. When these two different three of Diamonds (top and bottom) are placed together or adjacent to each other with the top three of Diamonds above the bottom three of Diamonds, a complete three of Diamonds is formed.

Players using the present invention can play additional games without having to remember new suits or new card values. Many new combinations of cards can now be formed using the present invention. For example, a player may have two cards containing the value nine, the top nine of Clubs and the bottom nine of Diamonds. Another player may also have a pair of nines, the top nine of Spades and the bottom nine of Spades. Depending on the rules of the game, the second player's combination of top and bottom of the same nine card, may defeat the first player's combination of nines.

Other features and advantages of the present invention will be apparent to those having ordinary skill in the art based on the accompanying drawings and description.

DETAILED DESCRIPTION OF THE INVENTION

Figure 1:
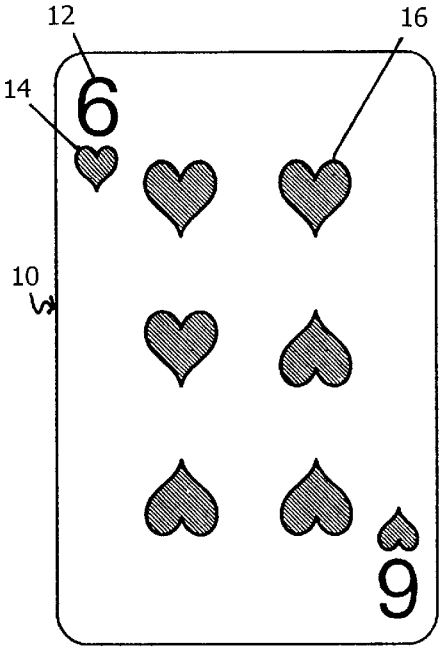
FIGURE 1 PRIOR ART
FIG. 1 is a front view of a single playing card from a standard deck of playing cards.

The front view of a standard playing card 10 from a standard deck of playing cards is shown in FIG. 1. The standard playing card 10 is made of a piece of paper or cardboard that is imprinted with a design on the front and back of the card and then laminated for strength. Each standard playing card is approximately 2.5 inches by 3.5 inches, thereby allowing a card player to comfortably hold a number of cards in his or her hand. However, card sizes may vary; smaller cards for younger people and smaller or larger cards for novelty reasons.

Each standard playing card contains a design on the back side of the card (not shown) which is similar to the design on the back side of all of the other cards, such that each card is indistinguishable from the other cards when viewed from the back side. Further, each standard playing card contains a value or quantity 12, either from two through ten, or a letter, A, K, Q, or J, representing Ace, King, Queen, or Jack, respectively. In the example shown in FIG. 1, the quantity is six.

Each standard playing card also contains a suit 14, either Spades, Hearts, Diamonds, or Clubs. Each suit has a separate insignia thereby making it easier for the player using the cards to know which suit is indicated on each card. In the example shown in FIG. 1, the suit indicated is a Heart. Therefore the playing card indicated in Figure one is the six of Hearts.

Further, for the cards numbered two through ten, and also for the cards containing the letter A, the number value of the playing card is indicated on the card by the similar number of suit indicators 16. In FIG. 1, there are six large Hearts to indicate that the card value is the six of Hearts (not including the smaller suit indicators at opposing corners of the card). The four of Clubs would contain four large Clubs on its face.

Since each suit contains a card with either the number two through ten, or the letters A, K, Q, or J, there are 13 cards per suit. Since there are four suits, a standard deck of cards contains 52 cards. In some card decks extra cards are included for particular game rules. These extra cards are well known as jokers.

Figure 2A:
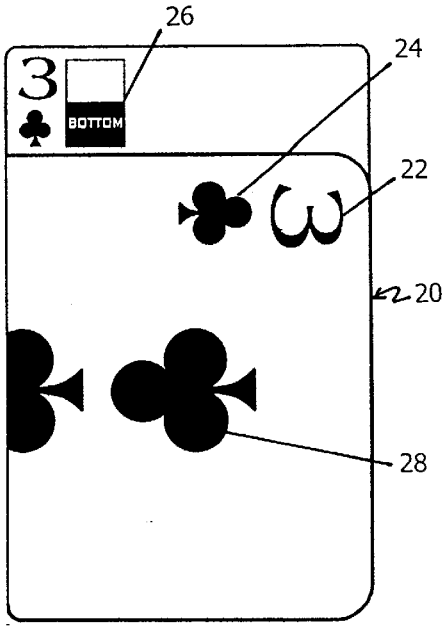
FIG. 2A is a front view of a single playing card embodying the present invention.

An embodiment of the present invention is shown in FIG. 2A which is a front view of a playing card 20 in accordance with the present invention. The playing card 20 which is similar to a playing card in a standard deck is made up of paper, cardboard or some other material that can be printed on and subsequently laminated for strength.

Figure 2B:
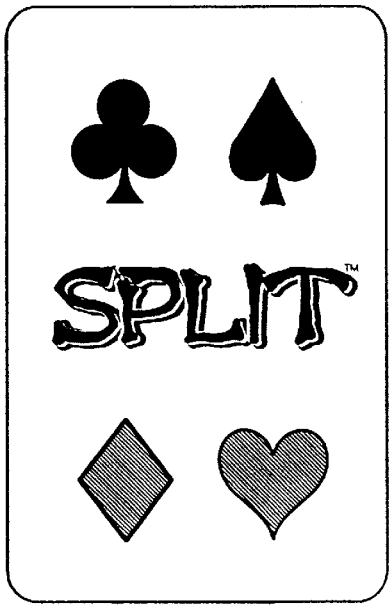
FIG. 2B is a back view of a single playing card embodying the present invention.

FIG. 2B shows the design printed on the back side of the playing card shown in 2A. The design is similar to the design on the back of all of the other cards in the deck, thereby making all of the cards in the deck indistinguishable from the others when viewed from the back side. The design shown in FIG. 2B is merely an example. There are many different designs that could be used, as long as each card contained a similar design.

The playing card 20 in FIG. 2A is made to the same approximate size as the playing card in a standard deck, 2.5 inches by 3.5 inches. However, the size of the card is not the essence of the present invention and therefore cards of other sizes can be made under the present invention.

The playing card 20 in the present invention, similar to a playing card in the standard deck, has a quantity or value 22 either a number between two and ten, inclusive, or a letter such as A, K, Q, or J. The card 20 shown in FIG. 2A is a three.

Also similar to a playing card in a standard deck, the playing card 20 in the present invention has a suit 24 indicated on its face. The suit 24 can be one of four different suits, Spades, Hearts, Diamonds, or Clubs. The card shown in FIG. 2A indicates a Club suit. Therefore, the card 20 shown in FIG. 2A is the three of Clubs.

The playing card 20 card may have an indication of location 26 displayed on the face of the card, such as bottom, to help the player understand which part of the card he or she may be holding. This location indicator 26 can be any indication, such as bottom, top, left, right, A, B, etc. such that the playing card can be placed adjacent to another card with the corresponding indicator, for example, Bottom with top, right with left, A with B, or even A with A, such that, as explained further below and in FIGS. 4 and 5, the playing card formed by the combination of the two cards adjacent to each other is the same as a standard playing card, but approximately twice the size. Further, the location indicator 26 may be color coded (not shown), for example, all top cards are yellow, and all bottom cards are purple, to further distinguish the different cards making the players recognition easier and faster.

FIG. 2A differs from most standard playing cards in that the card 20 does not display the number of suit indications equal to the quantity of the playing card. For example, the three of Clubs in a standard deck of playing cards would display the number 3 (usually on two opposing corners of the four corners of the card), with an indication of the particular suit, a Club, underneath the number 3. The three of Clubs would also display three Clubs in the middle of the playing card.

The present invention does not display the quantity of the particular suit that the card indicates, but instead, half the quantity of the particular suit is displayed. For example, the three of Clubs in the present invention displays only one and one half Clubs 28 on its face (not including the smaller indication of suit 24 underneath the number three 22. The quantity of the particular suit 28 is displayed in such a manner that when another playing card having the same quantity (regardless of suit) is placed next to or adjacent to the first card, a complete playing card, approximately twice the size of a standard playing card is formed.

Figure 3:
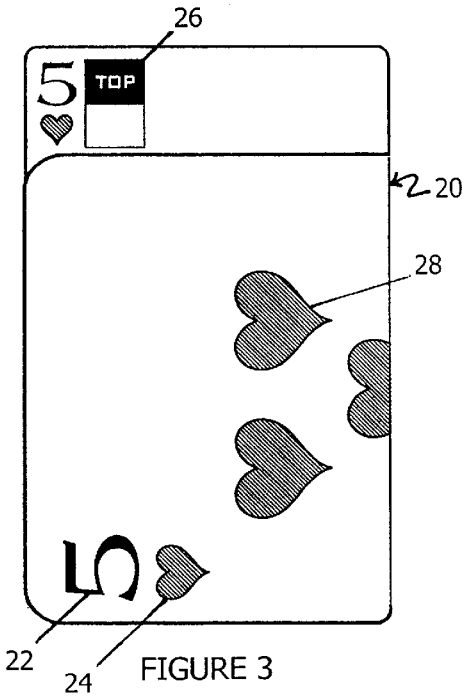
FIG. 3 is a front view of a single playing card embodying the present invention.

FIG. 3 shows a playing card 20 having the number five 22 as the quantity indicator, Hearts 24 is the suit indicator, two and one half Hearts 28 are displayed on the face of the card such that the card could be placed adjacent to another card having the quantity five thereby making a complete card with the combination, and top as the location indicator 26. Utilizing the 13 different quantities, the four different suit types, and the two location indicators, a total of 104 cards can be created without adding any new suits or quantities to a standard deck.

Figure 4:
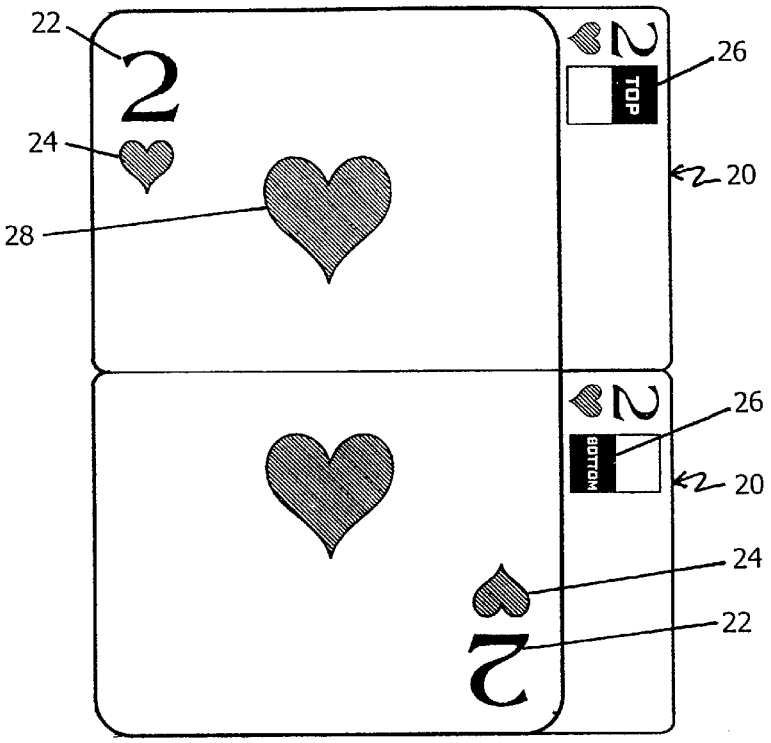
FIG. 4 is a front view of a two playing cards embodying the present invention, placed adjacent to each other.

FIG. 4 shows two playing cards 20 placed adjacent to each other in such a manner as to create a combination that is similar to a standard playing card, but approximately twice the size. The combination of cards 20 has two quantity indicators 22 at two of the corners of the combination of cards 20 (the number two) similar to a standard playing card, two suit indicators 24 underneath the quantity indicators (Hearts) similar to a standard playing card, and a display on the face of the combination of the two cards of the quantity of the particular suit 28 (the two large Hearts) similar to a standard playing card. These elements combined together make a combination of two adjacent playing cards 20 that are similar to a single playing card in a standard deck of cards, but approximately twice the size.

Figure 5:
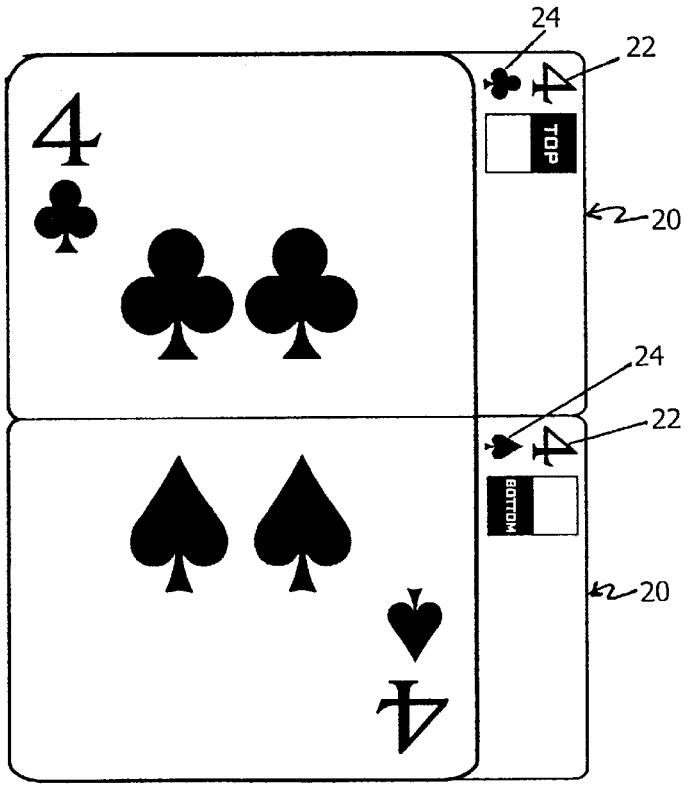
FIG. 5 is a front view of a two playing cards embodying the present invention, placed adjacent to each other.
Figure 6:
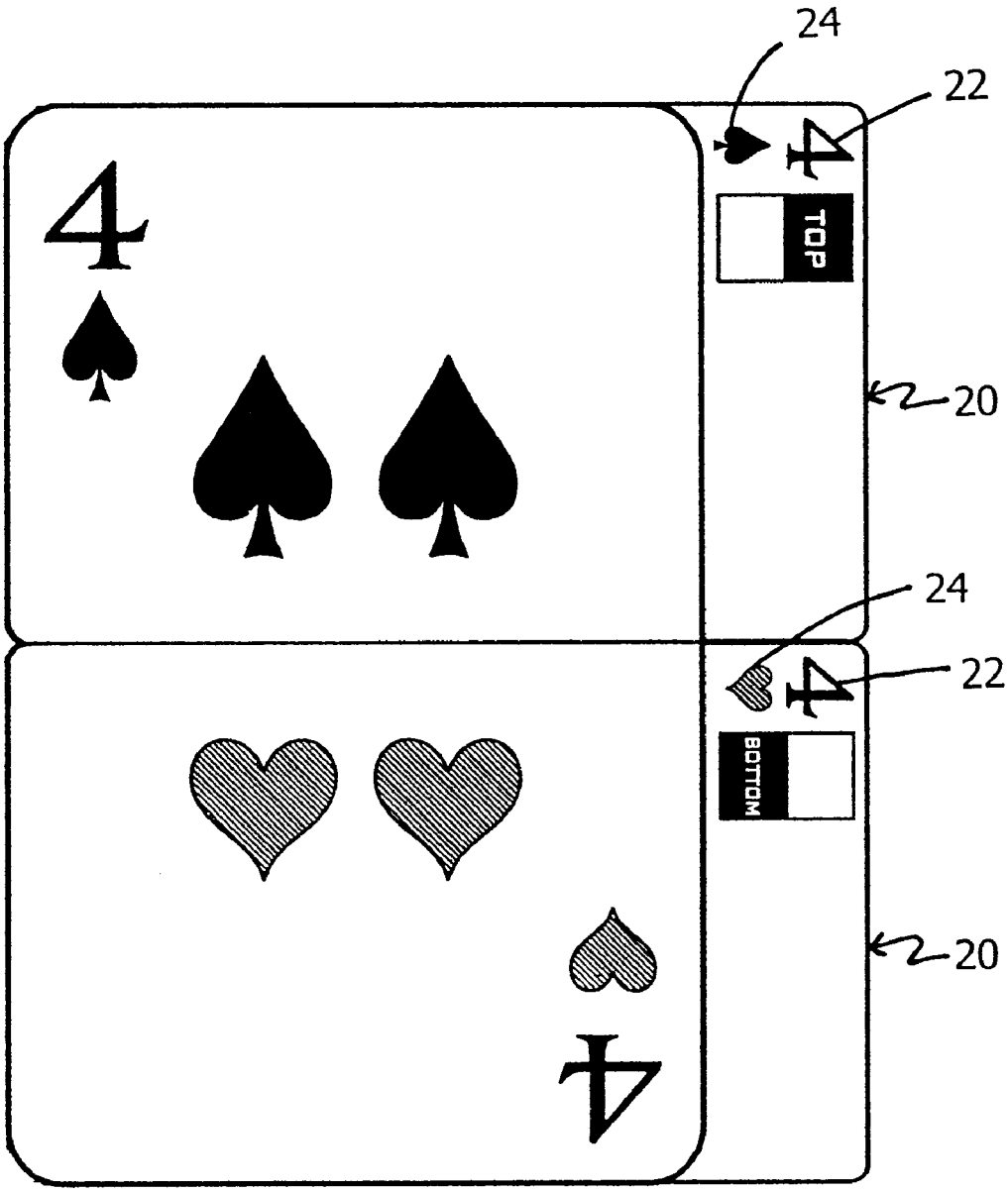
FIG. 6 is a front view of a two playing cards embodying the present invention, placed adjacent to each other.

FIGS. 5 and 6 show a second and third combination in which the two playing cards 20 placed adjacent to each other have the same quantity 22 but contain different suits 24. In FIG. 5, the suits are different, but the colors of the suits, black for Spades and Clubs, is the same. In FIG. 6, the suits are different and the color of the suits, black for Spades and red for Hearts, is different.

In certain game play, a combination of same cards (quantity and suit) with different location indicators (FIG. 4) may have greater value than a combination of cards in which the quantity is the same, but the suit indicators are of different type but same color (FIG. 5), which may in turn have a greater value than a combination of cards in which the quantity is the same, but the suit indicators are different and the color of the suits are different (FIG. 6). Names may be given to the combination described above such as Solid for FIG. 4, Soft for FIG. 5, and Weak for FIG. 6.

In another embodiment, cards can be configured to display only one quarter of a standard playing card such that, similar to the description above, each card would have a location indicator such that when the four cards are placed together a standard playing card is created by the combination except the new card would be four times the size of a standard playing card. Examples of location indicators would be top right, top left, bottom right, bottom left, A, B, C, D, etc.

It can easily be seen that many variations of common games can be played with the present invention. For example in Poker, a pair of Aces having the same suit might be a stronger hand than a pair of Aces having different suits.

Also, many games can be derived in which the present invention is used along with game boards and other pieces. For example, a game in which each player receives a certain number of cards and colored chips. The players attempt to put their cards down in combinations that, based on the combinations, allow them to place a certain number of chips in a predetermined location. The players object is to place his or her chips in a row to get points. A Solid combination allows the player to place three chips, a Soft combination allows the player to place two chips and a Weak combination allows a player to place one chip. However, one chip may be all that is needed to block another players row.

The foregoing detailed description of the invention is intended to be illustrative and not intended to limit the scope of the invention. Changes and modifications are possible with respect to the foregoing description, and it is understood that the invention may be practiced otherwise than that specifically described herein and still be within the scope of the claims.

What is claimed is:

1. A deck of game playing cards comprising a number of playing cards, each card having a front side of the card and a back side of the card, said back side either containing a design or not containing a design, such that each card contains a back side which is similar to each of the other, such that said cards cannot be distinguished by observing the back side of the card, said front side of each card containing an indication of location, quantity and suit, such that at least two cards of said deck contain the same quantity and suit and such that a first playing card may be placed either on a playing game board or some other location adjacent to a second playing card combining to form a standard playing card, but approximating twice the size of said first or second playing card.

2. A deck of game playing cards in accordance with claim 1, wherein said indication of location is an indication of either bottom or top, such that when said first playing card is placed adjacent to said second playing card said combination will consist of the playing card containing the top location indication on top of the playing card containing the bottom location indication.

3. A deck of game playing cards in accordance with claim 1, wherein said indication of location is an indication of either right or left, such that when said first playing card is placed adjacent to said second playing card said combination will consist of the playing card containing the left location indication to the left of the playing card containing the right location indication.

4. A deck of game playing cards in accordance with claim 1, wherein said indication of quantity is an indication of either a number or a letter.

5. A deck of game playing cards in accordance with claim 4, wherein said number is one of the set of numbers between two and ten inclusive.

6. A deck of game playing cards in accordance with claim 4, wherein said letter is either A, K, Q, or J.

7. A deck of game playing cards in accordance with claim 1, wherein said indication of suit is an indication of one of four different suits.

8. A deck of game playing cards in accordance with claim 7, wherein said indication of one of four different suits is an indication of either a Spade, a Heart, a Diamond or a Club.

9. A deck of game playing cards in accordance with claim 1, wherein said number of individual playing cards approximates 104 playing cards.

10. A deck of game playing cards in accordance with claim 1, wherein said playing cards each approximate the size of a playing card in a standard size deck of playing cards.

11. A deck of game playing cards comprising individual playing cards, each card having a front side of the card and a back side of the card, said back side either containing a design or not containing a design, such that each card contains a back side which is similar to each of the other cards, such that said cards cannot be distinguished by observing the back side of the card, said front side of each card containing an indication of quantity and suit, said deck of game playing cards comprising a first playing card and a second playing card, said first and second playing cards containing the same quantity and suit, such that said first playing card may be placed either on a playing game board or some other location adjacent to said second playing card, such that a combination of said first and second playing cards is similar to a playing card in a standard deck of playing cards, but approximating twice the size of said playing card in said standard deck of playing cards.

12. A deck of game playing cards in accordance with claim 11, wherein said indication of quantity is an indication of either a number or a letter.

13. A deck of game playing cards in accordance with claim 12, wherein said number is one of the set of numbers between two and ten inclusive.

14. A deck of game playing cards in accordance with claim 12, wherein said letter is either A, K, Q, or J.

15. A deck of game playing cards in accordance with claim 11, wherein said indication of suit is an indication of one of four different suits.

16. A deck of game playing cards in accordance with claim 15, wherein said indication of one of four different suits is an indication of either a Spade, a Heart, a Diamond or a Club.

17. A deck of game playing cards in accordance with claim 11, wherein said number of individual playing cards approximates 104 playing cards.

18. A deck of game playing cards in accordance with claim 11, wherein said playing cards each approximate the size of a playing card in a standard size deck of playing cards.

19. A deck of game playing cards in accordance with claim 11, further comprising an indication of location located on said front side of each card.

20. A deck of game playing cards in accordance with claim 12, wherein said indication of location is either an indication of top or bottom.

21. A deck of game playing cards in accordance with claim 19, wherein said indication of location is either an indication of right or left.

* * * * *